US007650104B2

(12) United States Patent
Baba et al.

(10) Patent No.: US 7,650,104 B2
(45) Date of Patent: Jan. 19, 2010

(54) DEVELOPING APPARATUS INCLUDING DEVELOPER CARRYING MEMBER AND DEVELOPER REGULATING MEMBER WITH SURFACE ROUGHNESS PARAMETERS

(75) Inventors: Daisuke Baba, Mishima (JP); Masahiro Yoshida, Tokyo (JP)

(73) Assignee: Canon Kabushiki Kaisha, Tokyo (JP)

( * ) Notice: Subject to any disclaimer, the term of this patent is extended or adjusted under 35 U.S.C. 154(b) by 513 days.

(21) Appl. No.: 11/678,297

(22) Filed: Feb. 23, 2007

(65) Prior Publication Data

US 2007/0201907 A1 Aug. 30, 2007

(30) Foreign Application Priority Data

Feb. 24, 2006 (JP) ..... 2006-049371

(51) Int. Cl.
*G03G 15/09* (2006.01)

(52) U.S. Cl. ..... 399/274; 399/276

(58) Field of Classification Search ..... 399/274, 399/276, 279, 284, 286
See application file for complete search history.

(56) References Cited

U.S. PATENT DOCUMENTS 6,163,663 A 12/2000 Shinohara et al.
6,334,038 B1 * 12/2001 Kawahara ..... 399/274
6,370,348 B1 4/2002 Okano et al.
6,463,246 B1 * 10/2002 Mizuno et al. ..... 399/284
6,847,796 B2 1/2005 Chigono et al.
6,909,869 B2 6/2005 Yamamoto et al. ..... 399/284
7,209,690 B2 * 4/2007 Koyanagi et al. ..... 399/279
2006/0078356 A1 4/2006 Inami et al.

FOREIGN PATENT DOCUMENTS

JP 62-242975 10/1987
JP 6-186838 7/1994
JP 2004-12542 1/2004
JP 2004-117919 4/2004

* cited by examiner

*Primary Examiner*—William J Royer
(74) *Attorney, Agent, or Firm*—Fitzpatrick, Cella, Harper & Scinto

(57) ABSTRACT

A developing apparatus includes: a developing sleeve that carries a mono-component developer; and a developing blade that abuts on the sleeve to regulate a layer thickness of the developer on the sleeve, wherein surface roughness parameters of the sleeve satisfy: $3.0 \leqq Rpk \leqq 9.0$; and $2 \leqq Pc2 \leqq 10$. At an abutment portion between the sleeve and the blade, surface roughness parameters of the blade satisfy: $0.030 \leqq Sm \leqq 0.170$; and $0.10 \leqq Rvk \times (100 - Mr2)/100 \leqq 1.30$, where Sm is a mean spacing of profile irregularities [mm]; Rpk is an initial wear height [μm]; Rvk is an oil retaining depth [μm]; Mr2 is a profile bearing length ratio 2 [%]; and Pc2 denotes the number of profile peaks having a height larger than a count level from a center line per the evaluation length of 1 mm.

8 Claims, 9 Drawing Sheets

$$Sm = \frac{\sum_{1}^{n} Smi}{n}$$

DEVELOPING APPARATUS INCLUDING DEVELOPER CARRYING MEMBER AND DEVELOPER REGULATING MEMBER WITH SURFACE ROUGHNESS PARAMETERS

BACKGROUND OF THE INVENTION

1. Field of the Invention

The present invention relates to a developing apparatus that performs a development using a mono-component developer, and is preferably applicable to an image forming apparatus of a laser beam printer, a copying machine, and the like, that forms images using an electrophotographic system or an electrostatic recording system.

2. Description of the Related Art

An electrophotographic image forming apparatus of a copying machine, a laser beam printer, and the like, forms an electrostatic image (latent image) by irradiating an electrophotographic photosensitive member (photosensitive member) with a light corresponding to image data. A toner of a developer as a recording material is supplied to the electrostatic image from a developing apparatus, to develop a toner image. The toner image is transferred from the photosensitive member to a recording material such as a recording paper by a transfer device. The toner image is fixed on the recording material by a fixing device, thus forming a recorded image.

A variety of apparatuses are proposed regarding a developing apparatus using a dry mono-component developing process. There is one in the following as an example. That is, a magnetic mono-component developer (magnetic toner) is carried on a developing sleeve serving as a developer carrying member, and a uniform toner layer is formed by a layer thickness regulating member. The developing sleeve is caused to be in close proximity to or come into contact with a photosensitive member. Then, a developing bias voltage composed of alternating current and direct current components, for example, is applied to the developing sleeve. As a result, an electric potential is generated between the electrostatic image on the photosensitive member and the developing sleeve. Thereby, toner is moved to the electrostatic image to perform a development.

To further describe, such a developing apparatus has a cylindrical-shaped developing sleeve provided rotatably at an opening of a developing container that contains a magnetic toner. Within the developing sleeve, there is provided a magnetic field generating unit (magnet roller) having a plurality of securely arranged magnetic poles. The magnetic toner is adsorbed onto the developing sleeve by the magnetic field generated by the magnetic field generating unit, and thereby the toner is carried on the developing sleeve and conveyed. Also, in such a developing apparatus, a toner layer is formed on the developing sleeve by a developer regulating member that abuts on the developing sleeve. As the developer regulating member, a blade-shaped member formed generally by an elastic body, that is, a developing blade is used.

In recent years, an enhancement of resolution, definition of images has been demanded, thus conglobation and reductions in the diameter of the toner used for the developing apparatus has progressed. In particular, a conglobated toner has been widely used because it has a high electrostatic charge amount per weight Q [μC/g], which effectively contributes to an improvement of reproducibility of dot image or fine-line image, and to an improvement of transferring property.

However, when the conglobated toner is used, the following problems may arise in some cases.

That is, regarding a toner with high sphericity, there is a tendency that a toner conveyance amount M [g/m$^2$] passing through the developing blade on the developing sleeve and conveyed to a developing region increases. In particular, the tendency appears during printing at a low coverage rate (output of images with low image ratio), or after idle rotation.

Then, there are cases where an excessive increase in a toner conveyance amount generates dispersion in the distribution of electrostatic charge amount of toner, induces an uneven to a toner coat on the developing sleeve, and causes an uneven image density to develop.

Also, an increase in the toner conveyance amount is likely to impart insufficiently an electrostatic charge to the toner between the developing sleeve and the developing blade. Thus, in some cases, conveyance of the insufficiently charged toner to a developing region causes, so called, a fogged image to occur in which the toner adheres to portions other than electrostatic latent images on the photosensitive member (non-image portions).

It was found that this tendency is peculiar, in particular, in a developing apparatus using a magnetic mono-component developer (magnetic toner). This is attributable largely to that, since the toner is carried by a magnetic force of a magnet within the developing sleeve, there is no action to brush off toner residue after developing by a feed roller like a developing apparatus using a non-magnetic mono-component developer (non-magnetic toner).

That is, this is probably because the toner residue after developing is not brushed off from the developing sleeve, but is coated on the developing sleeve together with a newly fed toner, and thus the toner coat becomes unstable.

As a unit to suppress the increase in a toner conveyance amount M [g/m$^2$], as described above, conventionally, a control has been performed mainly by a combination of methods (α) to (γ) as below.

(α) To reduce a surface roughness [μm] of the developing sleeve;

(β) To increase an abutment pressure P [g/cm] of the developing blade to the developing sleeve;

(γ) To shorten a distance (hereinafter referred to as "NE length") [mm] from an abutment position between the developing blade and the developing sleeve to a free end of the developing blade.

That is, any of methods (α) to (γ) is a method for regulating a toner conveying force mechanically and there is a limit depending on a manufacturing dispersion or a mounting dispersion. Also, an increase in an abutment pressure P [g/cm] causes a mechanical stress to the toner to increase, accelerates deterioration of the toner, and thus leading to reduction in the image density. Also, when a surface roughness of the developing sleeve is set low, the durability drops, and thus it is disadvantageous for higher-speed/longevity of the image forming apparatus.

Also, a variety of toner layer forming technologies are proposed.

There is a proposal relating to a developer regulating member, in which fluctuations of toner conveyance amount are suppressed over a long period of use by specifying surface roughness Ra [μm] of a soft elastic body serving as a layer forming member and curvature radius of concave portion (Refer to Japanese Patent Application Laid-Open No. 62-242975).

Also, there is another proposal, in which a uniform thin layer/an increase in electrostatic charge amount of magnetic mono-component developer (magnetic toner) are aimed at by specifying surface roughness Rz of a toner regulating member, and high-quality of images in initial use condition is aimed at (Refer to Japanese Patent Application Laid-Open No. 2004-117919).

Also, there is still another proposal, in which a uniform thin layer on an elastic developing roller and prevention of images from deteriorating after leaving them for a long period of time are aimed at by specifying surface roughnesses Ra, Rz, and Rmax of a developer regulating member (Refer to Japanese Patent Application Laid-Open No. 2004-12542).

As described above, a method for regulating roughness of surface of a developer regulating member with the aim to obtain a stable toner layer is an effective method. However, depending on surface shape of the developer regulating members, external additive agent liberated from the toner may become clogged into concave portions of the surface of the developer regulating member, and streak images may occur due to clogging.

As an external additive agent of toner, silica is named, for example. Also, particle diameter of the silica to be used for the external additive agent of toner is commonly in the order of 1 to 100 nm.

The above-mentioned streak image is more likely to occur particularly, since the external additive agent of toner is adapted to be easily liberated under a high-temperature high-humidity environment.

Also, the higher the rotational speed of a developer carrying member, namely, a developing sleeve, the more likely streak images tend to occur, since the external additive agent of toner is adapted to be easily liberated.

Also, the more the total number of rotations of a developing sleeve becomes, the more the amount of external additive agent that has been liberated from the toner becomes, thus the more likely streak images tend to occur.

Under such circumstances, there is a yet another proposal, in which, in order to prevent a developer from fixing to a developer regulating member, a resin coating layer is formed on the surface of the developer regulating member, and surface roughnesses Ra [μm] of the developer regulating member and a developer carrying member are specified (Refer to Japanese Patent Application Laid-Open No. 6-186838).

As described above, it was found that it is difficult to satisfy both of stability of developer layer thickness and prevention of streak images resulting from the clogging of external additive agent of developer into concave portions on the surface of the developer regulating member, only by paying attention to Ra, Rz, and Rmax regarding the surface roughnesses of the developer regulating member and the developer carrying member.

SUMMARY OF THE INVENTION

It is an object of the present invention to provide a developing apparatus that suppresses occurrence of streak images.

Another object of the present invention is to provide a developing apparatus that suppresses faulty images due to clogging of a developer on the surface of a developer regulating member.

A further object of the present invention is to provide a developing apparatus, capable of regulating a stable layer thickness of developer to the developer carried by a developer carrying member.

A yet another object of the present invention is to provide a developing apparatus capable of preventing a developer conveyance amount on a developer carrying member from becoming excessive.

Further objects and characteristics of the present invention will be understood more clearly by reading the detailed descriptions as below with reference to the accompanying drawings.

DETAILED DESCRIPTION OF THE PREFERRED EMBODIMENTS

Hereinafter, a developing apparatus according to the present invention will be described in detail with reference to the drawings.

First Embodiment

[Entire Configuration and Operation of Image Forming Apparatus]

Figure 1:
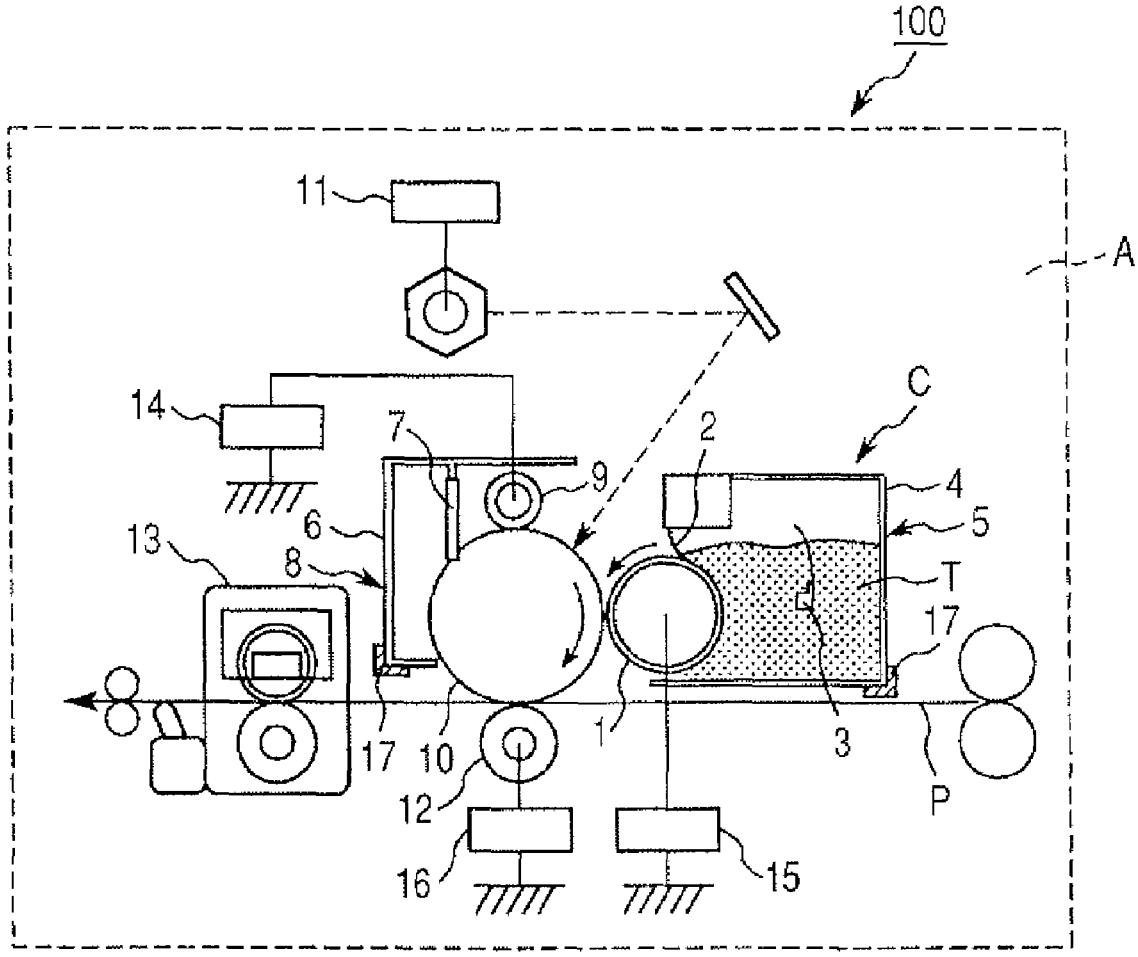
FIG. 1 is a schematic configuration cross-sectional view of an embodiment of an image forming apparatus according to the present invention.

FIG. 1 illustrates a schematic cross-sectional configuration of an embodiment of an image forming apparatus according to the present invention. An image forming apparatus 100 of the present embodiment is a laser beam printer that receives image information from a host computer, a network, and the like and forms output images on a recording material through an electrophotographic system according to the image information.

The image forming apparatus 100 has a cylindrical-shaped electrophotographic photosensitive member (hereinafter referred to as "photosensitive member") 10 as an image bearing member. The photosensitive member 10 is driven to rotate in the arrowed direction (clockwise). Around the photosensitive member 10, there is arranged a charging roller 9 serving as a charging unit for uniformly charging the photosensitive member 10. The charging roller 9 comes into contact with the photosensitive member 10 to rotate. Also, around the photosensitive member 10, there is arranged a developing apparatus 5 serving as a developing unit arranged non-contact opposed to the photosensitive member 10. Further, around the photosensitive member 10, there is arranged a cleaner 8 as a cleaning unit.

The developing apparatus 5 has, as described later, at least a developing sleeve 1 serving as a developer carrying member, a developing blade 2 serving as a developer regulating member (developer layer thickness regulating member), and a developing container 4 serving as a developer containing portion. Also, within the developing container 4, a developer agitating & conveying member 3 is provided. On the other hand, the cleaner 8 has a cleaning blade 7 serving as a cleaning member 7, and a waste toner container 6 that contains waste toner removed from the photosensitive member 10 by the cleaning blade 7.

In the present embodiment, the photosensitive member 10, the charging roller 9 as a process unit acting on the photosensitive member 10, the developing apparatus 5, and the cleaner 8 are integrally configured as a process cartridge C. The process cartridge C is designed to be detachably mountable to an image forming apparatus main body (apparatus main body) A according to a predetermined procedure.

That is, the apparatus main body A has a mounting unit 17 serving as a positioning member for positioning the process cartridge C within the apparatus main body A, and a guide member for guiding the process cartridge C into the apparatus main body A. The process cartridge C is detachably mounted to the apparatus main body A via the mounting unit 17.

Also, the image forming apparatus 100 has a laser scanner 11 as an exposure unit that irradiates a laser beam in response to image information, situated over the process cartridge C as shown in the drawing. Also, below the process cartridge C as shown in the drawing, a transfer roller 12 serving as a transfer unit is disposed at a position opposite to the photosensitive member 10. Also, a thermal fixing device 13 as a fixing unit is arranged on a downstream side of a recording material P in the moving direction relative to the transfer roller 12.

Further, the image forming apparatus 100 has a charging bias power source 14 as a charging bias voltage applying unit that applies a charging bias voltage to the charging roller 9 when forming images. Also, the image forming apparatus 100 has a developing bias power source 15 as a developing bias voltage applying unit that applies a developing bias voltage to the developing sleeve 1 when forming images. Also, the image forming apparatus 100 has a transfer bias power source 16 as a transfer bias voltage applying unit that applies a transfer bias voltage to the transfer roller 12 when forming images.

The photosensitive member 10 is driven to rotate in the arrowed direction when forming images. The surface of rotating photosensitive member 10 is uniformly charged by the charging roller 9. A charging bias voltage has been applied to the charging roller 9 by a charging bias power source 14. Subsequently, the surface of charged photosensitive member 10 is scanned and exposed by a laser beam irradiated from the laser scanner 11. Thereby, electrostatic images (latent images) are formed on the photosensitive member 10.

The electrostatic images formed on the surface of the photosensitive member 10 are visualized as toner images with toner T being caused to adhere thereto by the developing apparatus 5. At this moment, a developing bias voltage that is a superimposing voltage of direct current over alternating current is applied to the developing sleeve 1 of the developing apparatus 5 by the developing bias power source 15. By the developing bias action, the toner is transferred from the developing sleeve 1 to the electrostatic image formed on the photosensitive member 10.

Next, a recording material P is conveyed from a recording material supplying portion (not shown) provided with a paper feed cassette to a transfer portion where the photosensitive member 10 and the transfer roller 12 abut. The toner image on the photosensitive member 10 is transferred on the surface of the recording material P that is conveyed while being sandwiched between the photosensitive member 10 and the transfer roller 12 at a constant pressure. At this moment, a transfer bias voltage of reversed polarity relative to normal charging polarity of toner is applied to the transfer roller 12 by the transfer bias power source 16. The toner on the photosensitive member 10 is transferred onto the recording material P under an action of the transfer bias.

Further, the recording material P to which the toner image has been transferred is conveyed to the thermal fixing device 13, and heated and pressurized in the thermal fixing device 13. As a result, the toner image is fixed on the surface of the recording material P as a permanent image. Subsequently, the recording material P is discharged to the outside of the apparatus main body A.

It should be noted that, in the present embodiment, a cartridge that is detachably mountable to the image forming apparatus main body A is, but not limited to, a process cartridge C which integrally includes the photosensitive member 10, the charging roller 9, the developing apparatus 5 and the cleaner 8 into a cartridge system. For example, any process cartridge may be acceptable so long as it integrally includes at least the photosensitive member and the developing unit into a cartridge system. In addition to this, the process cartridge may further include at least one of the charging unit and the cleaning unit. Further, a cartridge that is detachably mountable to the image forming apparatus main body A may be a developing cartridge in which a developing apparatus is detachably mountable on a standalone basis to the image forming apparatus main body.

[Developing Apparatus]

Figure 2:
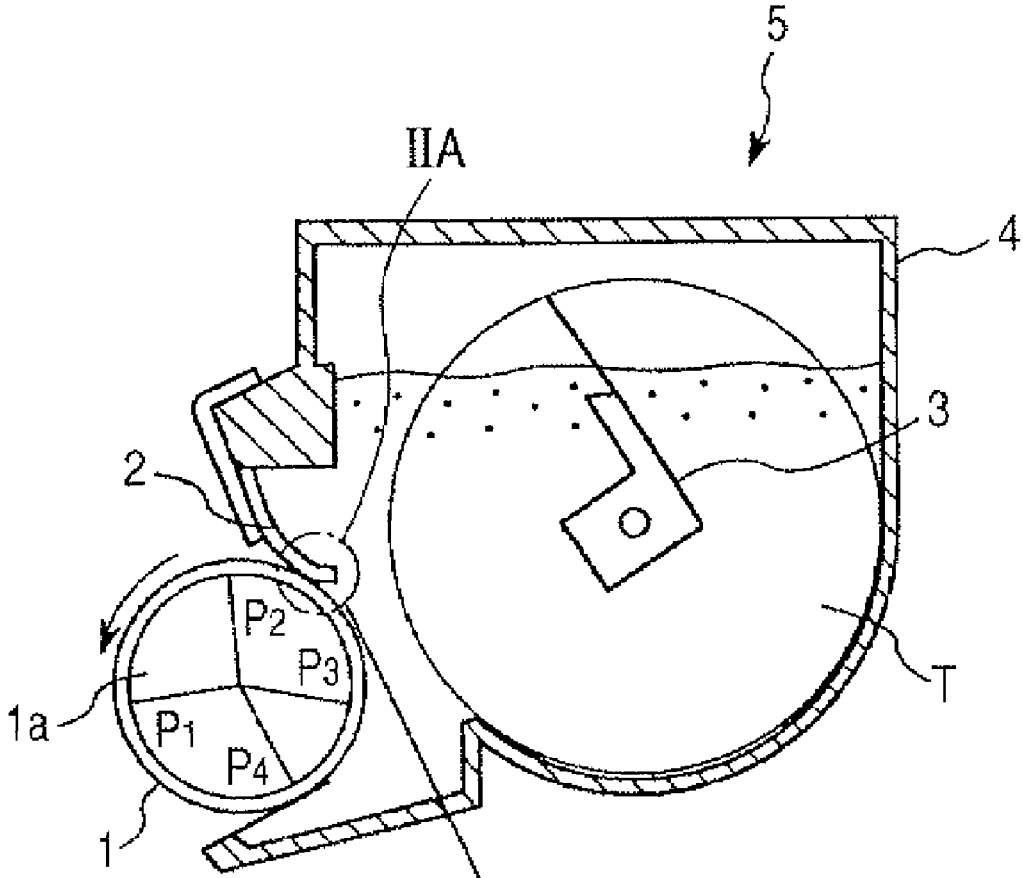
FIG. 2 is a schematic configuration cross-sectional view of an embodiment of a developing apparatus according to the present invention.
Figure 3:
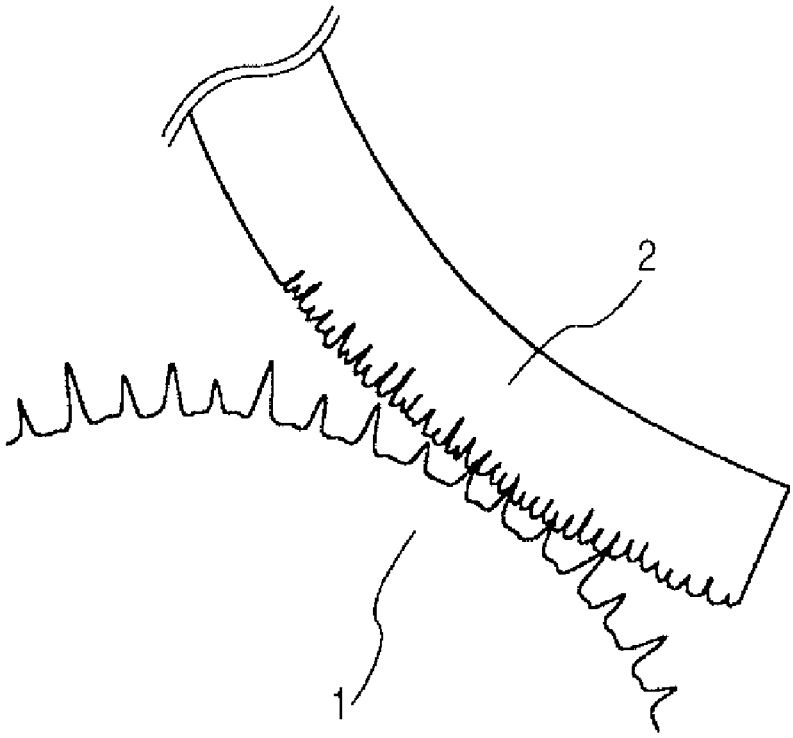
FIG. 3 is a diagrammatic sketch representing exaggeratedly a surface shape of an abutment portion (blade nip portion) between a developer layer thickness regulating member and a developer carrying member.

Next, the configuration of the developing apparatus 5 in the present embodiment will be described further in detail with reference to FIG. 2 and FIG. 3. FIG. 2 illustrates more in detail the cross-sectional configuration of the developing apparatus 5. Also, FIG. 3 illustrates exaggeratedly surface shapes of the developing sleeve 1 and the developing blade 2.

In the developing apparatus 5, in the present embodiment, a magnetic mono-component developer, namely, a magnetic toner T is contained as a developer within the developing container 4 serving as a developer containing portion. In the present embodiment, normal charging polarity of the toner T is negative polarity. Also, at the opening of the developing container 4 opposed to the photosensitive member 10, the developing sleeve 1 serving as the developer carrying member is rotatably arranged. Also, within the developing container 4, the agitating & conveying member 3 is provided for agitating and conveying the toner T contained therein to the developing sleeve 1.

In the present embodiment, the developing sleeve 1 is configured to form a conductive resin layer on a cylindrical-shaped aluminum raw pipe with diameter of 20 [mm]. Also, as the developing sleeve 1, the one having moderate concave and convex portions on a surface can be used preferably in order to increase a sliding and rubbing probability with the toner T and a toner conveying force. More specifically, as the developing sleeve 1, the one having concave and convex surfaces with surface roughness Ra of 0.5 to 2.0 [μm] can be preferably used.

Here, the surface roughness Ra is an arithmetic mean roughness (center-line mean roughness) [μm] specified in JIS-B0601-1994.

However, as described later, the suppression of streak images and stable developer layer thickness regulation can not be effected by simply paying attention to a surface roughness Ra of the developing sleeve 1. The streak image results from an external additive agent of developer becoming clogged into concave portion on the surface of the developing blade 2. By using the developing sleeve 1 and the developing blade 2 that are pursuant to the present embodiment, the above-mentioned suppression of the streak images and stable toner layer thickness regulation can be executed.

Within the developing sleeve 1, a magnet roller 1*a* as a magnetic field generating member for generating a magnetic field is securely arranged. The magnet roller 1*a* has a plurality of magnetic poles P1, P2, P3, and P4 in a circumferential direction.

The toner T that has been conveyed by the agitating & conveying member 3 is attracted by a magnetic force of a take-in magnetic pole P3 of the magnet roller 1*a* and taken-in on the developing sleeve 1. In the present embodiment, a flux density G at a surface position of the developing sleeve 1 of the take-in magnetic pole P3 was set at 60 to 80 [mT].

And, the developing apparatus 5, as described above, has the developing blade 2 serving as a developer regulating member (developer layer thickness regulating member) for regulating the layer thickness of toner layer on the developing sleeve 1. The developing blade 2 can be formed of a rubber member such as urethane, silicone and the like as an elastic member. In the present embodiment, the free end of the developing blade 2 faces the upstream side of the developing sleeve 1 in a rotating direction (counter direction), and the developing blade 2 abuts on the surface of developing sleeve 1 on the side in the vicinity of the free end thereof.

In the present embodiment, the developing blade 2 was caused to abut on the developing sleeve 1 under the condition of an abutment pressure P=10 to 50 [g/cm].

It should be noted that, an abutment pressure is determined as follows: first, three SUS sheets (thickness 50 μm, width w [cm]) are inserted, across an abutment nip between the developing sleeve 1 and the developing blade 2 in a state where no toner is present, and a spring pressure F [gf] is measured when the middle sheet is pulled off. A coefficient of friction μ between SUS sheets is measured. Then, the abutment pressure (line pressure) P=μF/w is obtained.

Figure 2A:
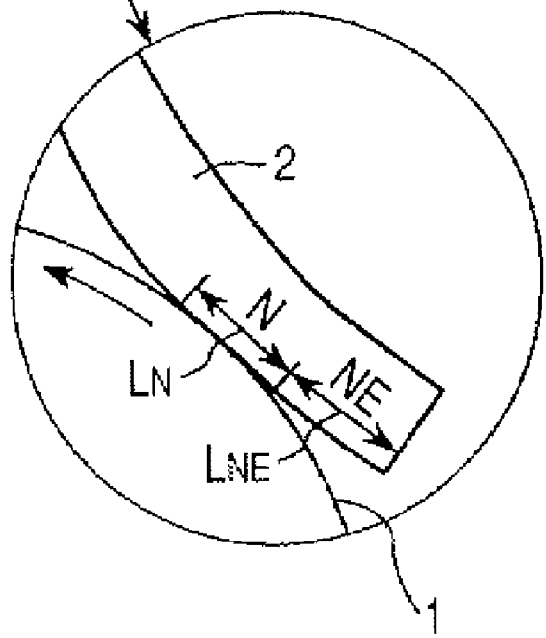
FIG. 2A is an enlarged view of the encircled portion IIA in FIG. 2.

Also, in the present embodiment, as illustrated in FIG. 2A, a distance $L_{NE}$ from an abutment portion (hereinafter referred to as "Blade Nip Portion") N between the developing sleeve 1 and the developing blade 2 to the free end of the developing blade 2 (hereinafter referred to as "NE Length") $L_{NE}$ was set at $L_{NE}$=0.1 to 3.0 [mm]. The NE length, more specifically, is a length from the end of upstream side of the developing sleeve 1 of the blade nip portion N in the surface movement direction to the free end of the developing blade 2.

Here, as described in detail later, at least an area corresponding to the blade nip portion N of the developing blade 2 is rendered as roughened surface. Also, width of the blade nip portion N in the surface movement direction of the developing sleeve 1 (hereinafter referred to as "Blade Nip Width") $L_N$ is preferably 0.4 [mm] or more. Thereby, an action of surface shape of the developing blade 2 that has been rendered as roughened surface can be made more effective. When a nip width $L_N$ is set at smaller than 0.4 [mm], the effect of roughened surface of the developing blade 2 is likely to be reduced. Stable regulation of toner layer thickness can be effected by securing abutment width of the developing blade 2 to the developing sleeve 1.

In a configuration where an elastic member as a developing blade is flexed to abut on the developing sleeve, the nip width is dependent on hardness of the elastic member, position of a fulcrum of flexure, and the like. However, when using a rubber member such as urethane, silicone, and the like, there is a limit for increasing the nip width. Accordingly, the nip width $L_N$ is normally 2.0 [mm] or less.

It should be noted that, the NE length and nip width were determined by observing an enlarged abutment surface of the developing blade 2 under a microscope after outputting images, and measuring a length of region where the toner is adhering.

Also, in the present embodiment, the developing bias voltage that is applied to the developing sleeve 1 by the developing bias power source 15 when forming images was assumed to be a rectangular wave bias voltage with superimposing of an alternating current component (peak-to-peak voltage: 1600 [V], frequency: 2000 [Hz]) over direct current component (−400 [V]).

Next, magnetic mono-component developer, namely, magnetic toner T, used in the present embodiment will be described.

The toner particles of the present embodiment, are obtained by crushing a mixture of magnetic iron oxide particles, wax, charge control agent into binding resin the main component of which is made up of styrene-acryl copolymer, and providing a sphering processing, with weight average particle diameter of 6.0 [μm]. The magnetic toner T was produced by adding and mixing 1.3 parts by mass of hydrophobic silica finely divided powder (average particle diameter of 10 nm) serving as external additive agent to 100 parts by mass of the toner particles.

Here, measurements of average particle diameter and degree of circularity of toner will be described.

First, particle diameter distributions of toner can be measured by various methods that have been known heretofore. Here, average particle diameters of toner were measured using Coulter Counter Multisizer II Type (100 μm aperture) manufactured by Coulter K.K. This is a method for measuring volume and number of developer, calculating volume distribution and number distribution, and determining weight average particle diameter of weight reference obtained from the volume distribution. From the number of toner particles applicable to target particle diameter in number distribution, the number % of toner particles with particle diameter equal to 4 μm or less. In the present embodiment, the toner containing 20 [%] of finely-divided toner amount (number of particles %) with weight average particle diameter of 6.0 [μm], particle diameter equal to 4 μm or less was used.

Next, circularity of toner can be represented using an average degree of circularity as a simple method for representing qualitatively the shapes of particles. Here, measurement was made using SYSMEX CORPORATION make Flow Particle Image Analyzer FPIA-1000. A circularity of measured particles is determined from the following equation (A):

$$\text{Degree of Circularity } a = L_0/L_1 \quad \text{(A)}$$

[In the equation, $L_0$ denotes a peripheral length of a circle having the same projection area as particle image; $L_1$ denotes a peripheral length of particle image].

Further, as shown in the following equation (B), a value obtained by dividing the total sum of degrees of circularities of all measured particles by the total number of particles is defined as an average degree of circularity.

$$b = \frac{\sum_{i=1}^{m} ai}{m} \quad \text{(B)}$$

[In the equation, b; average degree of circularity, ai: degree of circularity, m; number of measured particles]

It should be noted that, when the present invention is applied to toner with an average degree of circularity equal to 0.940 or greater, the effect of regulating toner layer thickness can be exploited more effectively. Also, as a toner particle diameter, the one with a weight average particle diameter in the range of 5.0 to 8.0 μm can be used preferably. That is, as described in detail later, with the developing blade 2 according to the present embodiment, stable toner layer thickness regulation can be performed, thereby high quality images can be obtained, even in the case of using sphered magnetic mono-component developer (magnetic toner).

[Developing Sleeve]

Next, the developing sleeve 1 in the present embodiment will be described further in detail.

The developing sleeve 1 of the present embodiment is produced by forming a conductive resin layer containing binding resin, conductive fine powder, and roughening particles on a cylindrical-shaped aluminum raw pipe with a diameter of 20 [mm], and the one with a volume resistivity of $10^{-2}$ to $10^{4}$ [Ω·cm] was used. Phenol resin was used for binding resin, carbon black and graphite for conductive fine powder, and spheroidal carbonaceous particles for roughening particles. The spheroidal carbonaceous particles are contained for purpose of forming moderate concave and convex portions on the surface to increase sliding and rubbing probability with toner T and conveying force of toner T. In the present embodiment, the surface of the developing sleeve 1 was prepared in a desired shape by regulating kinds and dispersion amount of the spheroidal carbonaceous particles.

[Developing Blade]

Next, the developing blade 2 in the present embodiment will be described in detail.

In the present embodiment, polyurethane rubber was used as a material of the developing blade 2, because of its superiority in abrasion resistance, small permanent set, and relatively low cost. The hardness of rubber in the range of 55° to 85° in terms of JIS-A hardness is satisfactory.

A manufacturing method for a sheet (urethane sheet) of urethane rubber that forms the developing blade 2 in the present embodiment is not particularly limited, but the sheet can be molded through a centrifugal molding process using a drum-shaped die mold or a process for charging and molding into die mold.

In the present embodiment, a die mold face side of the urethane sheet formed through the aforesaid molding process is used for an abutment surface to the developing sleeve 1 in the developing blade 2. It is cited as one characteristic, and an inner peripheral surface of the die mold is controlled in detail in order to obtain surface roughness of the developing blade 2 in the present embodiment.

Figure 4:
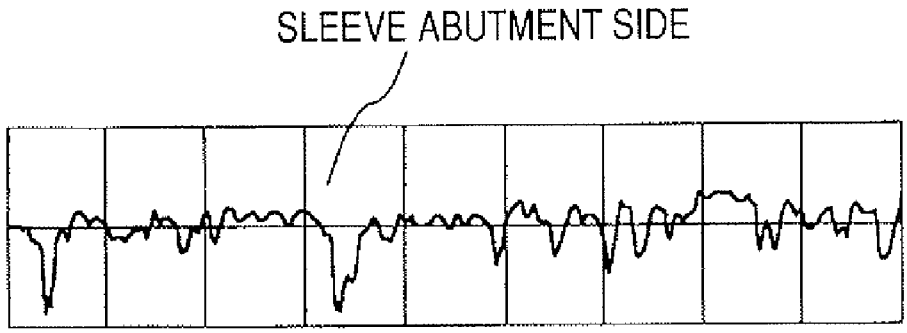
FIG. 4 is a diagrammatic sketch of a surface in one example of a development blade used in the present embodiment.

FIG. 4 illustrates one example of an urethane sheet surface used for the developing blade 2 in the present embodiment. FIG. 4 is a view illustrating the surface of urethane sheet with a ratio of vertical to horizontal directions (vertical:horizontal) of about 1:40.

Next, the surface of the developer carrying member, and surface roughness parameters of area corresponding to the blade nip portion N of the developing blade 2, on which attention is focused in the present invention, will be described.

The surface roughness parameters were measured using Contact Surface Roughness Measuring Instrument SE3500 (Kosaka Laboratory Ltd. make) under the following conditions:

Reference Length: 0.8 [mm]

Evaluation Length: 4.0 [mm]

Feed Speed: 0.1 [mm]

Filter: Gauss

Figure 5A:
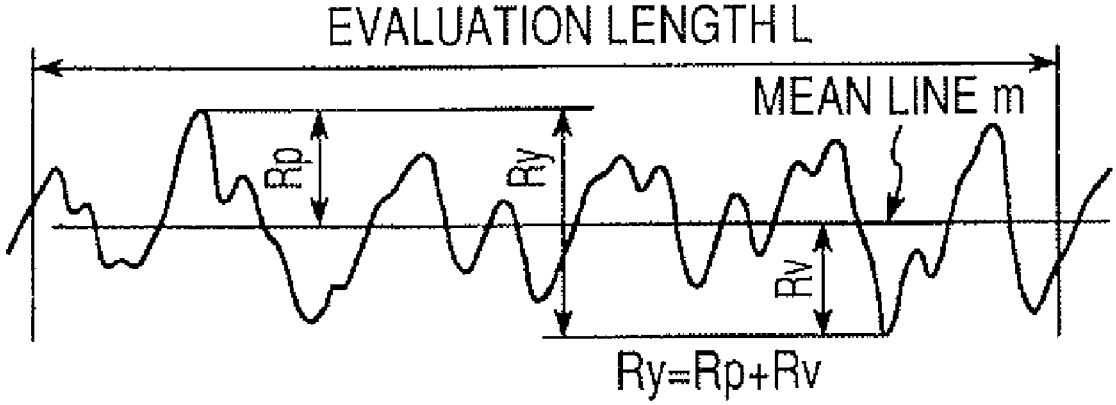
FIG. 5A and FIG. 5B are roughness curves for illustrating a surface roughness parameter Ry.
Figure 5B:
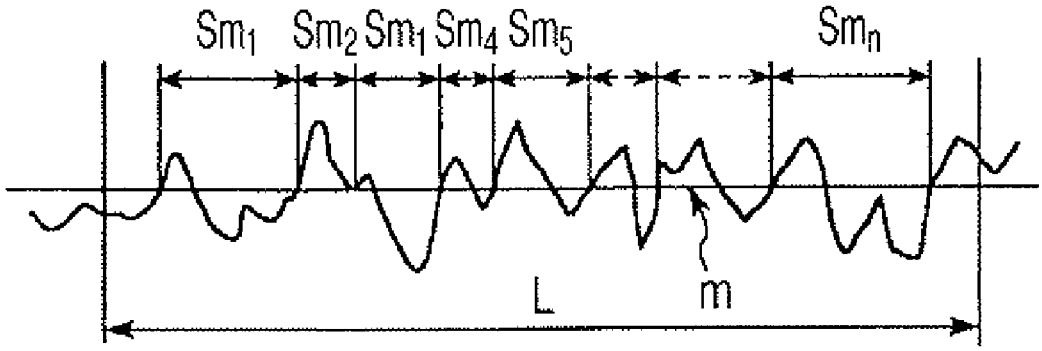

FIG. 5A and FIG. 5B are surface roughness profile views for illustrating roughness parameters.

Sm is a mean spacing of profile irregularities [mm]as specified in JIS-B0601-1994. Rz is a ten-point mean roughness [μm] as specified in JIS-B0601-1994.

Ry (Rmax) is a maximum height [μm] as specified in JIS-B0601-1994.

Figure 6A:
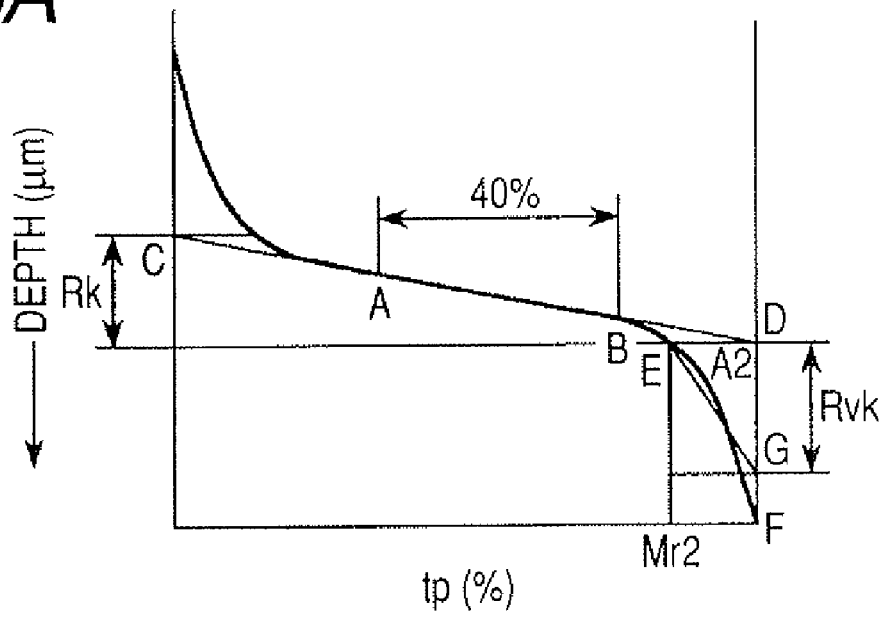
FIG. 6A is a bearing curve for illustrating surface roughness parameters Rvk and Mr2.
Figure 6B:
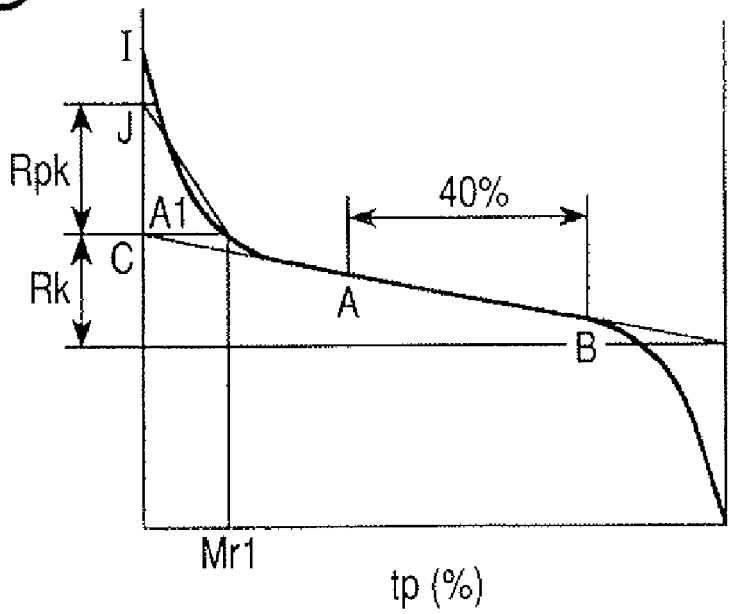
FIG. 6B is a bearing curve for illustrating a surface roughness parameter Rpk.

FIG. 6A and FIG. 6B are bearing curves for illustrating other surface roughness parameters.

The bearing curve has an axis of abscissa which represents a ratio (relative bearing length tp) [%] of the sum of line segments lengths of cutting edges to the reference length L, when cutting a surface roughness profile by a line with a certain height (DEPTH) [μm] parallel to mean length in the reference length L. And, the curve has an axis of ordinate which represents a height (DEPTH) [μm] in depth direction.

Among the straight lines passing through two points (points A, B) on the bearing curve and having the difference in tp values between point A and point B equal to 40%, determine the straight line with the smallest inclination. Let points of intersection of this straight line with tp 0%, 100% to be point C, point D, respectively. Also, let the points on the bearing curve at tp 0%, 100% to be point I, point F, respectively. Let a depth between point C and point D to be a level difference Rk in core portion. Let an intersection point between a cut level line passing through this point D and the bearing curve to be point E. At this time, determine a point G over tp 100% such that an area surrounded by the line segment DE, the line segment DF, the curve EF may become equal to an area of a triangle DEG. Let a distance between point D and point G to be Rvk, and let tp value at point E to be Mr2. And, let an intersection point between a cut level line passing through point C and the bearing curve to be point H. At this point, an area surrounded by the line segment CH, the line segment C1, the curve HI may become equal to an area of a triangle CHJ. Let a distance between point C and point J to be Rpk, tp value of point H to be Mr1.

Here, Rpk is an initial wear height of profile peak that is beyond a level difference Rk in core portion) [μm]. Rvk is an oil retaining depth (a depth of valley portion that is beyond a level difference Rk in core portion) [μm]. Mr2 is a profile bearing length ratio 2 [%] (a profile bearing length ratio equivalent to a lower limit value of a level difference Rk of core portion).

Let A2 to be an oil retaining area expressed by the following equation, $$A2 = Rvk \times (100 - Mr2)/100$$

These surface roughness parameters, Rpk, Rvk, Mr2, and A2 are specified by DIN 4776. DIN is an abbreviation for DEUTSCHE NORMEN enacted by DIN DEUTCHES INSTITUT FUR NORMUNG E.V.

Figure 7:
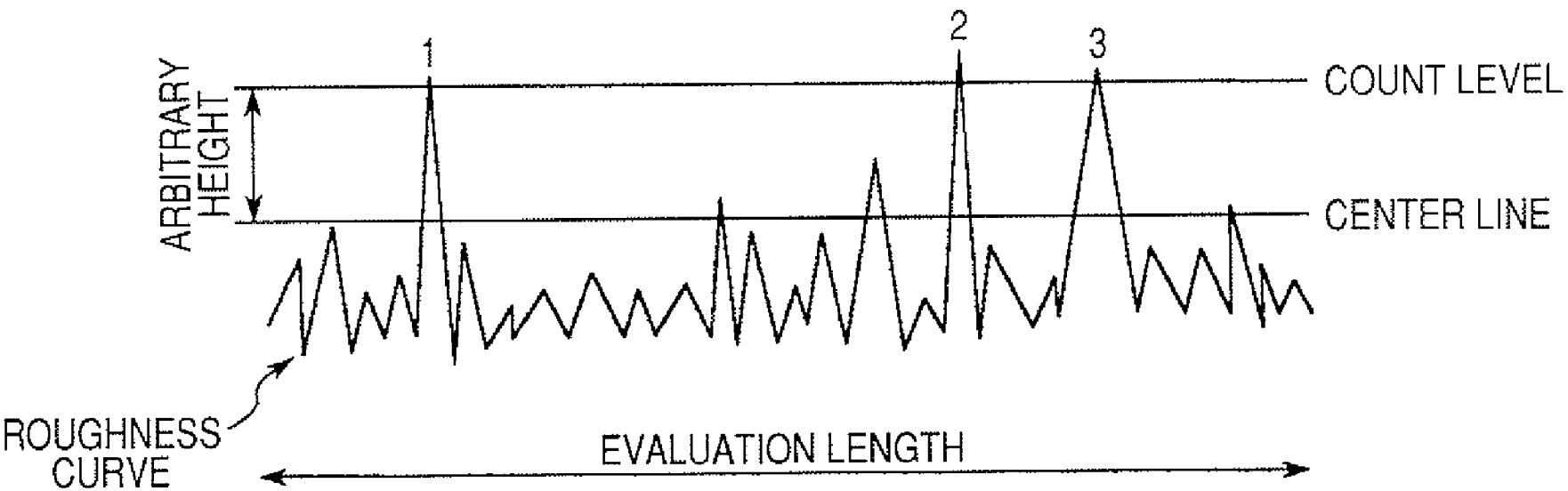
FIG. 7 is a roughness curve for illustrating a surface roughness parameter Pc2.

FIG. 7 is a surface roughness profile chart for illustrating another roughness parameter Pc2. Pc2 is a parameter measured in the Contact Surface Roughness Measuring Instrument SE 3500 (Kosaka Laboratory Ltd. make). Pc2 is given by the number of profile peaks having higher height than a count level (arbitrarily variable) with a center line as a reference per an evaluation length in the roughness curve. In the case of FIG. 7, the number of profile peaks that exceed the count level is three, then Pc2=3. In the present embodiment, measurement was made letting an evaluation length be 1 mm, a count level be ½ height of average particle diameter of toner. In the present embodiment, since toner with an average particle diameter of 6.0 μm is to be used, a count level as referred to here is specifically 3.0 μm.

Incidentally, one of the objects of the present invention is to enable a stable toner layer thickness regulation on a developer carrying member by an inexpensive method, while suppressing streak images. One of more specific objectives of the present invention is to prevent the occurrence of streak images, and to enable a stable toner layer thickness regulation over a long period of time by an inexpensive method, even in the case that toner with high circularity is used.

Consequently, the following factors will be considered.

(1) With Respect To Toner Layer Thickness Regulating Capability (Suppressing Capability for Toner Conveyance Amount):

It is effective to create conveyance resistivity to toner T by increasing a capacity of concave portions of the surface of the developing blade 2. It was found that it is substantially related to an oil retaining portion area A2. In other words, it will be an important consideration that an area ratio of valley portions that are beyond the core section is equal to a predetermined value or greater.

Also, there is a proper range for Sm. In the case that a capacity of concave portion is small, the effect of regulating the conveyance of the toner T becomes small with increasing Sm. On the other hand, even if Sm is too small, conveyance resistivity of the toner T is considered to become small. According to the present inventor et al, if Sm was 0.03 [mm] or over, good results were obtained. Also, it was difficult to make the developing blade 2 with Sm of 0.03 [mm] or less through the above-mentioned manufacturing process.

(2) With Respect to Streak Images Due to External Additive Agent Liberated from Toner:

It was found that streak images due to external additive agent liberated from toner can be avoided by making a height of convex portion on the surface of the developing sleeve to be equal to a predetermined height or greater, and providing a space for the toner to be able to penetrate between convex portion and flat portion. Specifically, it becomes a point that roughness parameter Rpk for a surface of the developing sleeve is equal to a predetermined height or greater. By doing this, the toner ceases to be directly sandwiched between the developing sleeve surface and the developing blade, and toner surface is not strongly rubbed to the developing blade surface. As a result, it is possible to prevent the external additive agent of the toner from being clogged into concave portion of the developing blade 2.

In other words, it is a characteristic of the present invention to obtain a surface shape of the developing blade 2 that satisfies both of the above (1) and (2).

Hereinafter, experimental examples will be cited and described. The experimental examples as below are provided with the aim to facilitate the understanding of the present invention. It should be understood that there is no intention to limit the present invention to only specific configurations as described below.

EXPERIMENTAL EXAMPLE 1

In the image forming apparatus 100 having the aforesaid configuration, actual printing operations were attempted by changing variously the settings in connection with degree of circularity of the toner T and the developing blade 2. Ra=1.2 [μm], Rpk=5.0 [μm] are given for the developing sleeve 1. Table 1 shows the image evaluation and the results of measurements of toner conveyance amounts (toner coating amount) M [g/m$^2$] and toner charge amounts Q [μC/g].

The image forming apparatus (laser beam printer) 100 used is capable of outputting 55 sheets per minute, and a rotational speed of the developing sleeve 1 was 367 [mm/sec]. The followings image evaluations were made.

Image Evaluation (i): Observation of uneven image density (uneven image) and uneven toner coat on the developing sleeve 1 (uneven coat) in halftone images (600 dpi, coverage rate of 80%) that were output from continuous printing. It is noted that, the aforesaid evaluation was made after 10000 sheets were printed under low temperature low humidity environment (15° C./10%).

Image Evaluation (ii): 20000 sheets of horizontal line images (600 dpi, coverage rate of 2%) were printed on intermittent printing, and subsequently, 10 sheets of the aforesaid halftone images were printed, and vertical streaks on the halftone images (streaks in conveying direction of a recording material: streak images) were evaluated. It is noted that, the aforementioned evaluation was made under high temperature high humidity environment (32.5° C./80%).

Also, toner conveyance amounts M [g/m$^2$] and toner charge amounts Q [μC/g] on the developing sleeve 1 were measured under low temperature low humidity environment (15° C./10%) in the following manner.

The toner on the developing sleeve is sampled by a suction process in a state after blank copy images (images with image ratio of 0%) have been printed. And, the sampled toner was measured using KEITHLEY make Electro-Meter 6514. That is, sampled toner weight [g/m$^2$] per area of toner sampling surface on the developing sleeve 1, and electric charge amount Q [μC/g] per sampled toner weight were measured. Also, image density was measured by means of a Macbeth reflection densitometer (RD918).

In the scope of the present embodiment, dot reproducibility, sharpness of line images, and other image qualities become more favorable for larger Q/M.

TABLE 1

| | Blade Roughening | Average Degree of Circularity of Toner | P [g/cm] | $L_{NE}$ [mm] | −Q [μC/g] | M [g/m$^2$] | Uneven Image | Streak Image |
|---|---|---|---|---|---|---|---|---|
| Example 1-1-1 | Yes | 0.962 | 25 | 1.5 | 6.0 | 17 | ○ | ○ |
| Example 1-2 | Yes | 0.962 | 15 | 1.5 | 5.0 | 20 | ○ | ○ |
| Example 1-3 | Yes | 0.962 | 25 | 3.0 | 6.0 | 20 | ○ | ○ |
| Example 1-4 | Yes | 0.942 | 25 | 1.5 | 4.8 | 17 | ○ | ○ |

TABLE 1-continued

| | Blade Roughening | Average Degree of Circularity of Toner | P [g/cm] | $L_{NE}$ [mm] | −Q [μC/g] | M [g/m$^2$] | Uneven Image | Streak Image |
|---|---|---|---|---|---|---|---|---|
| Example 1-5 | Yes | 0.935 | 25 | 1.5 | 3.0 | 17 | ○ | ○ |
| Example 1-6 | Yes | 0.925 | 25 | 1.5 | 3.0 | 17 | ○ | ○ |
| Example 1-7 | Yes | 0.972 | 25 | 1.5 | 6.0 | 19 | ○ | ○ |
| Comparative Example 0-1 | No | 0.962 | 25 | 1.5 | 4.0 | 26 | x | ○ |
| Comparative Example 0-2 | No | 0.962 | 15 | 1.5 | 2.5 | 28 | x | ○ |
| Comparative Example 0-3 | No | 0.962 | 25 | 3.0 | 2.8 | 29 | x | ○ |
| Comparative Example 0-4 | No | 0.942 | 25 | 1.5 | 3.5 | 24 | x | ○ |
| Comparative Example 0-5 | No | 0.972 | 25 | 1.5 | 4.0 | 28 | x | ○ |

COMPARATIVE EXAMPLE 0

First, the results of smooth surfaces of the developing blade 2 will be described. The surface shapes of the developing blade 2 that were used then, can be represented by surface roughness parameters. The parameters are described as Comparative Example 0 (smooth) in the Table 2 that shows the result of the Experimental Example 2 as below.

COMPARATIVE EXAMPLE 0-1

A developing blade 2 that was not subjected to surface roughening processing was used. Others were under the same conditions as in the present embodiment. As toner T, magnetic toner T with an average degree of circularity of 0.962 was used. In this case, the toner T becomes easy to pass through a blade nip portion N, thus toner conveyance amount increases. As a result, there were dispersions in toner T charge distributions, uneven coat occurred, and uneven image occurred. Also, electrostatic charge imparted to the toner T was insufficient due to increased amount of conveyed toner, resulting poor dot reproducibility.

COMPARATIVE EXAMPLES 0-2

When an abutment pressure P [g/cm] between the developing blade 2 and the developing sleeve 1 is small, toner conveyance amount increased further, thus uneven coat, and dot reproducibility became worse.

COMPARATIVE EXAMPLE 0-3

When NE length $L_{NE}$ [mm] of the developing blade 2 was large, toner conveyance amount increased further, consequently uneven coat, and dot reproducibility became worse.

COMPARATIVE EXAMPLE 0-4, 0-5

With a configuration of Comparative Example 0-1, an example in which circularities of the toner T were changed as a parameter. For the toner with average degree of circularity equal to 0.940 or more, toner conveyance amount increased, thus uneven coat, and dot reproducibility were poor.

Also, when abutment pressure P [g/cm] between the developing blade 2 and the developing sleeve 1 was set at high value, or when NE length L [mm] of the developing blade was set at short value, or when surface roughness Ra [μm] of the developing sleeve 1 was set at small value, toner conveyance amount was more likely to be suppressed. However, the toner T was deteriorated speedily, and image density decreased after long period of use.

Also, in Comparative Example 0-1 to Comparative Example 0-5, no streak images occurred in image evaluation (ii).

EXAMPLE 1

Next, the results of the case where the surface of the developing blade 2 was subjected to surface roughening processing (the present embodiment) will be described.

EXAMPLE 1-1-1

The developing blade 2 that was subjected to surface roughening processing according to the present embodiment was used. As toner T, magnetic toner T with an average degree of circularity of 0.962 was used. In this case, proper toner conveyance amount could be achieved by executing surface roughening processing on the surface of the developing blade 2. The surface shape of the developing blade 2 that was used at this time can be represented by surface roughness parameters. These surface roughness parameters are described in Table 2 that shows the result of the following Experimental Example 2.

EXAMPLE 1-2

Evaluation was made using the same developing blade 2, under the same conditions as the aforementioned Examples 1-1-1 except that abutment pressure was set at lower value. In this case, toner conveyance amount increased to some degree, by setting abutment pressure P [g/cm] low, but no poor images occurred, and stable toner layer thickness regulation could be performed. Also, satisfactory image density could be obtained over a long period of time due to reduction in mechanical stress imparted to the toner T.

EXAMPLE 1-3

Evaluation was made using the same developing blade 2, under the same conditions as the aforementioned Examples 1-1-1 except that NE length $L_{NE}$ [mm] was set large, using the same developing blade 2. In this case, toner conveyance amount increased to some degree, by setting NE length L

[mm] large, but no poor images occurred, and stable toner layer thickness regulation could be performed.

EXAMPLE 1-4 TO EXAMPLE 1-7

With a configuration of Example 1-1-1, an example in which circularities of toner T were changed as a parameter. For the toner T with large average degree of circularity, toner coat amount tends to increase. However, it is found that toner coat amount tends to be stable by executing surface roughening processing to the developing blade 2.

Also, in Example 1-1-1, Example 1-2 to Example 1-7, no streak images as in image evaluation (ii) occurred.

Further, experiment was conducted with changing the abutment conditions, namely, changing nip width $L_N$. The result was that toner coat amount increased for the case where nip width $L_N$ was smaller than 0.40 [mm]. Conversely, when nip width $L_N$ was set at 0.40 [mm] or over, the result was obtained that toner coat amount became stable. The presence of at least two concave and convex portions (profile irregularities) in rotating direction of the developing sleeve 1 within the blade nip portion is considered to be favorable for obtaining the effect of regulation.

pressure/NE length, thus the effect can be exerted even in the case that abutment pressure or NE length fluctuates.

That is, according to the present embodiment, stable toner layer thickness regulation can be performed, with being hardly affected by change in condition in the vicinity of blade nip portion N and the toner T resulting from environmental change, mounting accuracy, and other factors. For this reason, disadvantage in cost aspects incurred by provision of additional unit, parts and increased mounting accuracy can be avoided.

EXPERIMENTAL EXAMPLE 2

Next, the developing blades 2 having various surface shapes were prepared under varied manufacturing conditions in surface roughening processing. Image evaluations (i) and (ii) were made in the same manner as the above-mentioned Experimental Example 1. The evaluation results are shown in Table 2.

It should be noted that, at this time, abutment pressure P=25 [g/cm], NE length L=1.5 [mm] were taken, and the developing sleeve 1 had Ra=1.2 [μm], Rpk=5.0 [μm].

TABLE 2

| | Rz | Ry | A2 | Sm | Rvk | M [g/m$^2$] | Uneven Image | Streak Image |
|---|---|---|---|---|---|---|---|---|
| Example 1-1-1 | 2.50 | 3.50 | 0.29 | 0.05 | 1.01 | 17 | ○ | ○ |
| Example 2 | 2.00 | 3.10 | 0.21 | 0.11 | 1.06 | 18 | ○ | ○ |
| Example 3 | 3.00 | 4.50 | 0.10 | 0.12 | 1.21 | 19 | ○ | ○ |
| Example 4 | 3.50 | 5.50 | 0.22 | 0.03 | 2.21 | 19 | ○ | ○ |
| Example 5 | 5.10 | 6.50 | 0.15 | 0.12 | 1.66 | 18 | ○ | ○ |
| Example 6 | 6.30 | 9.00 | 0.54 | 0.10 | 1.28 | 17 | ○ | ○ |
| Example 7 | 7.20 | 9.50 | 0.82 | 0.09 | 3.50 | 16 | ○ | ○ |
| Example 8 | 5.00 | 6.50 | 0.14 | 0.16 | 1.87 | 20 | ○ | |
| Example 9 | 2.52 | 5.60 | 0.24 | 0.12 | 2.10 | 17 | ○ | ○ |
| Example 10 | 3.72 | 6.00 | 0.34 | 0.07 | 1.95 | 16 | ○ | ○ |
| Example 11 | 9.12 | 11.00 | 0.81 | 0.15 | 3.56 | 16 | ○ | ○ |
| Example12 | 10.30 | 14.50 | 1.31 | 0.17 | 5.53 | 16 | ○ | ○ |
| Comparative Example 0 (Smooth) | 0.26 | 0.34 | 0.01 | 0.30 | 0.13 | 26 | x | ○ |
| Comparative Example 1 | 2.50 | 3.50 | 0.06 | 0.08 | 0.46 | 26 | x | ○ |
| Comparative Example 2 | 3.50 | 5.00 | 0.09 | 0.10 | 0.81 | 25 | x | ○ |
| Comparative Example 3 | 3.50 | 5.40 | 0.14 | 0.21 | 0.71 | 23 | Δ | ○ |
| Comparative Example 4 | 4.30 | 5.70 | 0.15 | 0.25 | 0.89 | 24 | x | ○ |
| Comparative Example 5 | 15.00 | 21.00 | 1.62 | 0.24 | 3.12 | 16 | ○ | x |

Summary of Results of Table 1

Thus, surface roughening processing is executed on the surface of the developing blade 2, as is the case with Example 1 that is pursuant to the above-mentioned present embodiment. By executing this processing, it is found that stable toner layer thickness regulation can be performed, with being hardly influenced by fluctuations of abutment pressure and NE length compared with Comparative Example 0. That is, according to the present embodiment, conveyance resistivity is imparted to toner T with the help of concave and convex shapes of the surface of the developing blade 2, thereby an advantage is made of a mechanism to suppress toner conveyance amount. For this reason, the surface roughening processing acts additionally on a control by a conventional abutment

EXAMPLES

Example 1-1-1, Example 2

In Example 1-1-1 and Example 2, the developing blade 2 has relatively small values of Rz, Ry, but has a sufficient value of A2. Accordingly, favorable toner layer thickness regulation could be performed.

Example 3

In Example 3, Rz, Ry values of the developing blade are larger, but A2 value is smaller, Sm value is somewhat larger compared with Example 1-1-1 and Example 2. Consequently, toner conveyance amount meagerly increased, but favorable toner layer thickness regulation could be performed.

Example 4, Example 5, Example 6, and Example 7

In Example 4, Example 5, Example 6, and Example 7, the developing blade 2 enabled toner conveyance amount to be suppressed since A2 value was fully secured.

Example 8

In Example 8, Sm value of the developing blade 2 was adjusted so as to be larger than that in Example 3. In this case, toner conveyance amount increases, in spite that Rz, Ry, and A2 values are larger, for example, compared with Example 3. This represents that toner layer thickness regulating capability decreased since Sm value was large. However, in Example 8, no poor images occurred, and toner layer thickness regulation could be performed.

Example 9, Example 10, Example 11, and Example 12

In Example 9, Example 10, Example 11, and Example 12, the developing blade 2 was adjusted so as to increase A2 value. In this case, A2 is adequately secured, thus the effect of suppressing the toner conveyance amount is significant.

Also, in Example 1-1-1, and Example 2 to Example 12, no streak images as in image evaluation (ii) occurred.

COMPARATIVE EXAMPLES

Comparative Example 1 and Comparative Example 2

Comparative Example 1 and Comparative Example 2 are executed by different preparation methods, respectively. However, each is designed to have relatively large Rz, Ry, compared with Example 1-1-1, Example 2, and Example 3, for example, but to have surface shape with small A2. In the printing tests using the developing blades 2 with these parameters, toner conveyance amount increased, and image uneven occurred in each blade. From this fact, capacity of concave portion has an effect on toner layer thickness regulating capability, and it is found that poor images develop due to shortage of toner layer thickness regulating capability, in the case of small A2.

Comparative Example 3 and Comparative Example 4

In Comparative Example 3 and Comparative Example 4, the developing blade 2 is designed to have surface shape with large Sm compared with Example 5, for example. These cases have seen tendency of toner conveyance amount to somewhat increase, and slight image uneven occurred in the printing tests. From this fact, it is revealed that Sm value has an effect on the toner layer thickness regulating capability, thus it is necessary to reduce Sm value in order to perform stable toner layer thickness regulation.

Comparative Example 5

In Comparative Example 5, the developing blade 2 was prepared so that A2 value becomes large. In this case, spherical particles aggregate in a mold releasing layer in die mold, accordingly concave-and-convex uneven, island-like uneven become large, resulting in surface shapes with large uneven profile irregularities concave-and-convex (large Sm). Toner layers are partially disturbed resulting from these facts, thereby streak images occurred if concave portion is excessively large, toner coagulates lightly at concave portion, coat is disturbed, seemingly producing coat streaks.

Also, in Comparative Examples 1 to 5, no streak images as in image evaluation (ii) occurred.

Summary of Results of Table 2

The results as described above will be organized.

(1) With Respect to Toner Layer Thickness Regulating Capability (Suppressing Capability for Toner Conveyance Amount):

FIG. 7 illustrates the result of uneven coat (uneven image) with reference to A2 and Sm. A2 falls in the following range as a surface roughness parameter of blade nip portion N of the developing blade 2 from which satisfactory result is obtained regarding stability of toner layer thickness regulating capability.

$0.1 \leqq A2$

That is, it is effective to generate conveyance resistivity to toner by increasing capacity of the surface of concave portion in the developing blade 2. If A2 is 0.1 or greater, the effect is obtained.

Also, Sm falls in the following range as a surface roughness parameter of blade nip portion N of the developing blade 2, which offers satisfactory result regarding stability of toner layer thickness regulating capability.

$0.030 \leqq Sm \leqq 0.200$

In particular, when Sm exceeds 0.2, regulating capability becomes small, in the region where A2 is small, thus uneven coat occurred. Also, as for lower limit of Sm, favorable result is obtained if Sm is 0.030 or over.

Also, Sm and A2 are taken favorably in the following ranges, respectively, as surface roughness parameters of blade nip portion N of the developing blade 2, which offers satisfactory result regarding the prevention of streak images.

$0.030 \leqq Sm \leqq 0.170$ $A2 \leqq 1.30$

Figure 8:
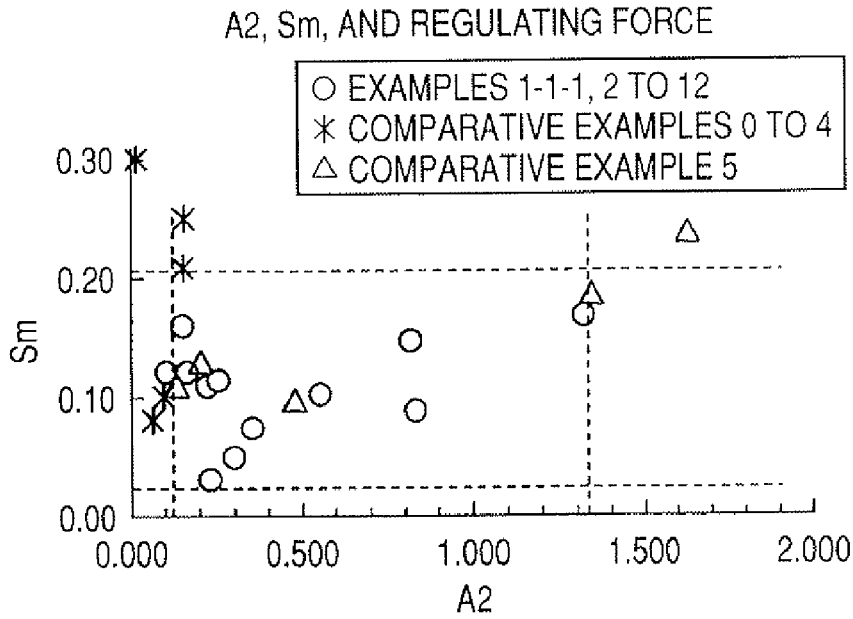
FIG. 8 is a graph representing a surface shape of the developing blade with surface roughness parameters A2 and Sm.

That is, as illustrated in FIG. 8, an upper limit of A2 has no limit from a relationship between A2 and Sm from viewpoint of toner layer thickness regulating capability. However, when A2 becomes large, Sm tends to become large too. When A2 and Sm become large, uneven concave and convex (profile irregularities) become large, and thus coat streak occurred (Comparative Example 5). This seems to be because, when concave portion becomes too large, toner lightly coagulates at concave portion, and toner coat on the developing sleeve 1 is disturbed, resulting in forming streaks. From this point, upper limits of Sm and A2 are determined.

That is, as described above, it is important to have such a shape as to secure a capacity (A2) at concave portion as a surface shape of the developing blade 2. In other words, it is characterized in that a surface shape of blade nip portion N of the developing blade 2 that is pursuant to the present invention has a large A2 in place of Rz.

Figure 9:
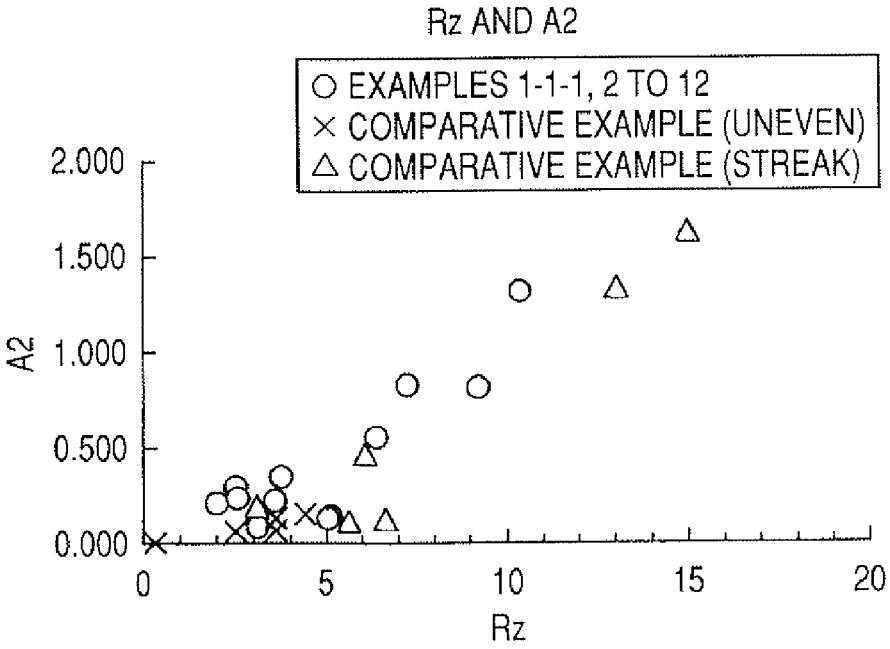
FIG. 9 is a graph representing a surface shape of the developing blade with surface roughness parameters Rz and A2.

FIG. 9 illustrates a relationship between Rz and A2. It is found that A2 is large relative to Rz from plots in Examples (Example 1-1-1, and Example 2 to Example 12) that are pursuant to the present invention, compared with Comparative Example in which uneven coat (uneven image), coat streak (streak image) occurred.

Further, the setting of proper Sm has the effect of improving uniformity of toner coat on the developing sleeve 1.

Figure 10:
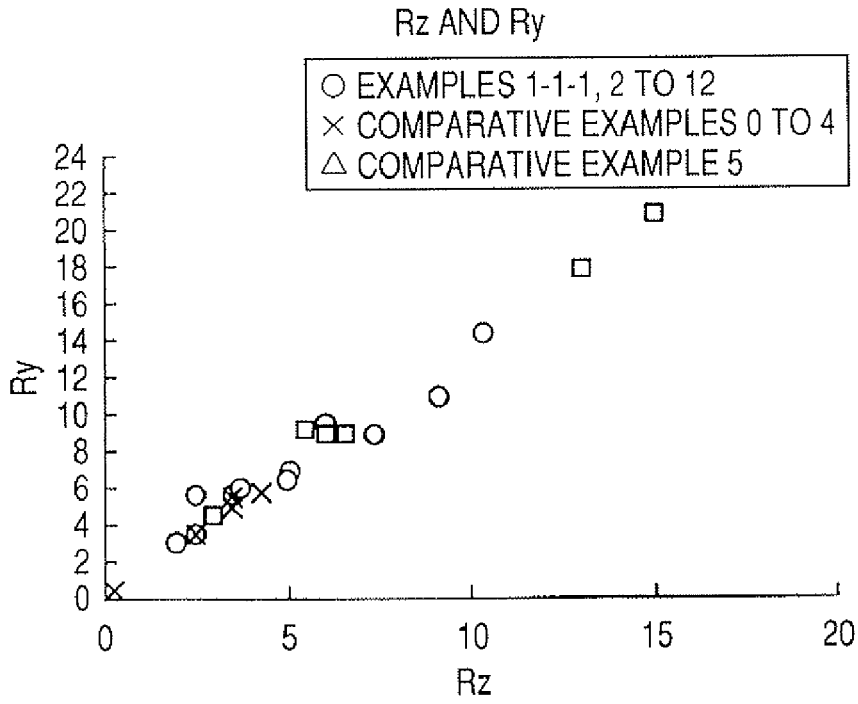
FIG. 10 is a graph representing a surface shape of the developing blade with surface roughness parameters Rz and Ry.

Contrary to this, as illustrated in FIG. 10, it is found that it is difficult to represent surface shape of the developing blade 2 that is needed for improving toner layer thickness regulating capability in terms of Rz and Ry (Rmax) values.

Experimental Example 3

Next, the developing sleeves 1 having various surface shapes were prepared under varied fabricating conditions, and image evaluations (i) and (ii) were made in the same manner as the aforesaid Experimental Examples 1 and 2. The evaluation result is shown in Table 3.

It should be noted that, at this time, the developing blade as shown in Example 1-1 was used under conditions of abutment pressure P=25 [g/cm], NE length L=1.5 [mm].

TABLE 3

| | Roughness Parameter of Developing Sleeve | | | | | M | Uneven | Streak |
|---|---|---|---|---|---|---|---|---|
| | Ra | Rz | Ry | Rpk | Pc2 | [g/M$^2$] | Image | Image |
| Example 1-1-1 | 1.22 | 11.44 | 13.77 | 5.87 | 4 | 17 | ○ | ○ |
| Example 1-1-2 | 1.41 | 11.98 | 13.56 | 6.87 | 6 | 19 | ○ | ○ |
| Example 1-1-3 | 1.03 | 8.49 | 10.60 | 4.60 | 3 | 15 | ○ | ○ |
| Example 1-1-4 | 1.40 | 14.20 | 16.68 | 8.56 | 10 | 19 | ○ | ○ |
| Example 1-1-5 | 1.00 | 8.01 | 10.54 | 3.05 | 2 | 15 | ○ | ○ |
| Comparative Example 1-1-1 | 1.21 | 6.46 | 7.36 | 1.46 | 3 | 17 | ○ | x |
| Comparative Example 1-1-2 | 1.38 | 6.87 | 8.13 | 1.65 | 6 | 19 | ○ | x |
| Comparative Example 1-1-3 | 1.60 | 6.91 | 8.36 | 1.62 | 8 | 21 | ○ | x |
| Comparative Example 1-1-4 | 1.43 | 7.13 | 8.23 | 2.30 | 5 | 15 | ○ | x |
| Comparative Example 1-1-5 | 1.36 | 17.32 | 20.36 | 11.56 | 10 | 19 | ○ | x |

EXAMPLES

Example 1-1-1

In Example 1-1-1, the developing sleeve was prepared using spherical carbonaceous particle with average particle diameter of 10 μm for roughening particle. Since a roughness of the developing blade has an appropriate value, no uneven image has occurred. Since Rpk of the developing sleeve is sufficiently large, no streak images have also occurred.

Example 1-1-2

In Example 1-1-2, Ra of the developing sleeve is set at slightly higher value by changing the amount of roughening particles to Example 1-1-1. Since Ra is slightly higher, toner conveyance amount meagerly increases. But, since roughness of the developing sleeve is set at an appropriate value, uneven image has not occurred. Since Rpk of the developing sleeve is set at sufficiently large value, no streak images have also occurred.

Example 1-1-3

In Example 1-1-3, Ra of the developing sleeve is set at slightly lower value by changing the amount of roughening particles with respect to Example 1-1-1. Since Ra is slightly lower value, toner conveyance amount minutely decreases. No uneven image occurred. Since a value of Rpk of the developing sleeve is a sufficiently large, no streak images occurred too.

Example 1-1-4

In Example 1-1-4, Ra and Rpk of the developing sleeve were meagerly increased by changing particle diameters and input amounts of roughening particles to Example 1-1-1. Since Ra is slightly larger, toner conveyance amount meagerly increased, but since roughness of the developing blade has an appropriate value, no uneven image occurred. Since Rpk value of the developing sleeve is sufficiently large, no streak images occurred too.

Example 1-1-5

In Example 1-1-5, Ra and Rpk of the developing sleeve were minutely decreased by changing particle diameters and input amount of roughening particles to Example 1-1-1. Since Ra is slightly low, toner conveyance amount minutely decreases. No uneven image occurred. Since Rpk of the developing sleeve is somewhat slightly low, but no streak images occurred too.

COMPARATIVE EXAMPLES

Comparative Example 1-1-1

In Comparative Example 1-1-1, Rpk of the developing sleeve was decreased by changing particle diameters and input amounts of roughening particles to the aforesaid Example. Since the roughness of the developing blade has an appropriate value, no uneven image occurred. However, streak images occurred in image evaluation (ii). When toner coat on the developing sleeve 1 was observed, sharp non-coat portion was present in rotating direction of the developing sleeve. When a nip of the developing blade 2 was observed, dirt/debris were observed at an area corresponding to non-coat portion of the developing sleeve. When the dirt/debris were subjected to elemental analysis using HORIBA Ltd. make Energy Dispersive X-Ray Analyzer EMAX-5770W, it was revealed that the majority of dirt/debris are silica serving as additive agent of toner. Since Rpk of the developing sleeve is low, the toner was directly sandwiched between the developing sleeve surface and the developing blade, and toner surface was strongly rubbed by the developing blade surface. As a result, it is considered that additive agent of the toner was crammed into concave portions of the developing blade 2, thereby the coat on the developing sleeve was disturbed, and thus streak images occurred.

Comparative Example 1-1-2

In Comparative Example 1-1-2, Ra of the developing sleeve is set at slightly high value by changing the amount of roughening particles with respect to Comparative Example 1-1-1. Since Ra is slightly high, toner conveyance amount is meagerly increases. But, since roughness of the developing blade has an appropriate value, no image uneven has occurred. Since Ra is slightly high, and toner conveyance amount is slightly high, and pressure applied on per one grain of toner is minutely decreased, which is a favorable trend for prevention of streaks. However, since Rpk of the developing sleeve is not high enough, streak image which is the same as Comparative Example 1-1-1 occurred.

Comparative Example 1-1-3

In Comparative Example 1-1-3, Ra of the developing sleeve is set at slightly high value by changing the amount of roughening particles with respect to Comparative Example 1-1-1. Since Ra is slightly high, toner conveyance amount is significantly increased. But, roughness of the developing blade has an appropriate value, no uneven image has occurred. Since Ra is slightly high, and amount of transported toner is slightly high, pressure applied on per one grain of toner is reduced, which is a favorable trend for prevention of streaks. However, since Rpk of the developing sleeve is not high enough, streak image that is the same as Comparative Example 1-1-1 has occurred.

Comparative Example 1-1-4

In Comparative Example 1-1-4, Ra and Rpk of the developing sleeve are set at slightly high value by changing the particle diameter and amount of roughening particles with respect to Comparative Example 1-1-1. Since Ra is slightly high, amount of transported toner is meagerly increases. But, since roughness of the developing blade has an appropriate value, no image uneven has occurred. Since Ra is slightly high, and toner conveyance amount is slightly high, and pressure applied on per one grain of toner is minutely decreased, which is a favorable trend for prevention of streaks. However, since Rpk of the developing sleeve is not high enough, streak image that is the same as Comparative Example 1-1-1 occurred.

Comparative Example 1-1-5

In Comparative Example 1-1-5, Rpk of the developing sleeve has become highest relative to hitherto Examples and Comparative Examples by changing particle diameter and amount of roughening particles. Since Ra is slightly high, toner conveyance amount also meagerly increases. But, since roughness of the developing blade has an appropriate value, no image uneven has occurred. However, in image evaluation (i), streak images have occurred. When toner coat on the developing sleeve 1 was observed, sharp streak portion was present in rotating direction of the developing sleeve. When a nip of the developing blade 2 was observed, no dirt/debris were present. From this fact, even if Rpk of the developing sleeve 1 is too high, it is found that streak image occurs. This is considered to be because convex portion of the developing sleeve 1 is too high, and coat difference from flat portion becomes too high.

Summary of Results of Table 3

Figure 11:
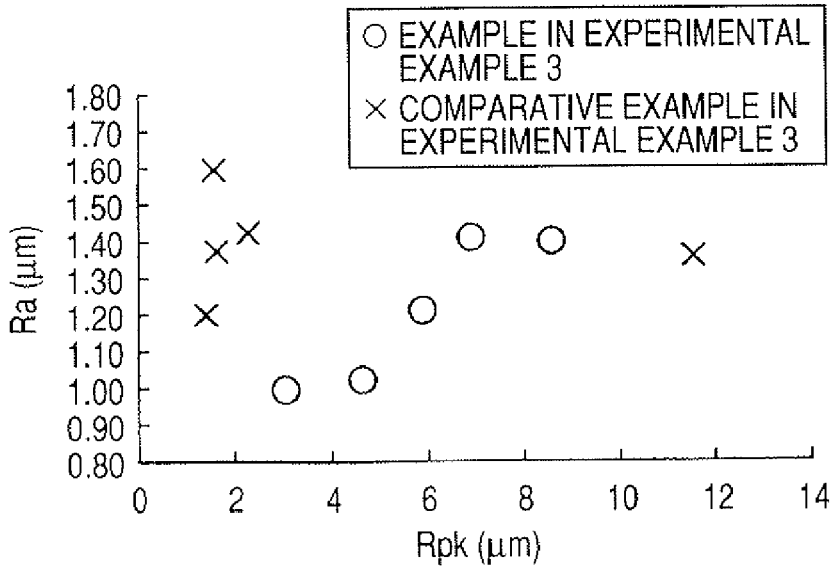
FIG. 11 is a graph representing a surface shape of a developing sleeve with surface roughness parameters Rpk and Ra.

FIG. 11 illustrates the result of streak images as a function of Rpk and Ra of the developing sleeve. It is obvious that the result of streak images has no correlation with Ra. Contrary to this, there is a correlation between streak image and Rpk, and it is found that a proper range in which no streak images occur is given as follows:

$3.0 \leqq Rpk \leqq 9.0$

A lower limit of Rpk is determined from the range in which no streak images are produced, resulting from that additive agent of developer is clogged into concave portion of the developing blade surface. Upper limit of Rpk is determined from the range in which no streak images are produced. Streak images result from that convex portion of the developing sleeve is too high, and coat difference from flat portion becomes too high.

Figure 12:
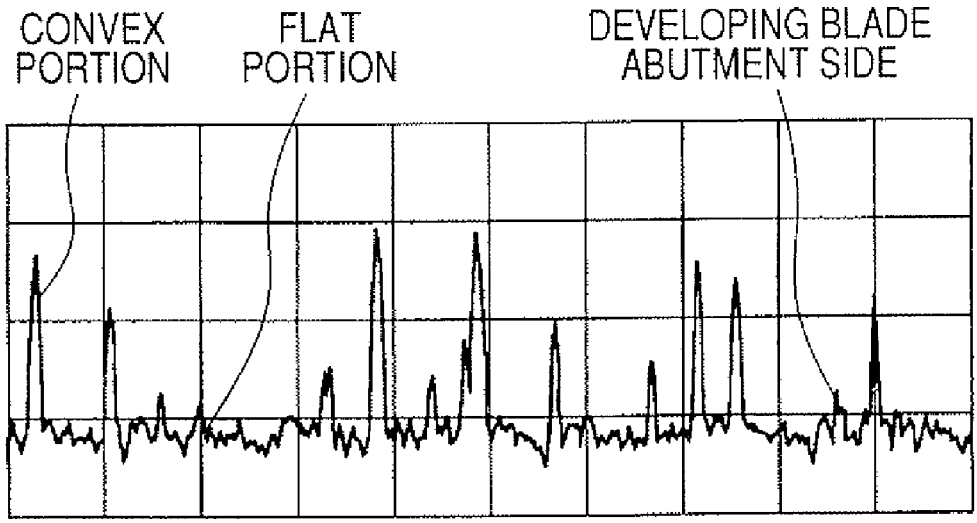
FIG. 12 is a diagrammatic sketch of a developing sleeve surface equivalent to Example 1-1-1.

FIG. 12 illustrates an example of developing sleeve surface equivalent to Example 1-1-1 that falls in the range in which no streak images are produced. Since there is a sufficient space between convex portion and flat portion of the developing sleeve surface, toner is not directly sandwiched between the developing sleeve surface and the developing blade. For this reason, toner surface is not strongly rubbed onto the developing blade surface, thus additive agent of the toner can be prevented from being clogged into the concave portion of the developing blade 2.

Figure 13:
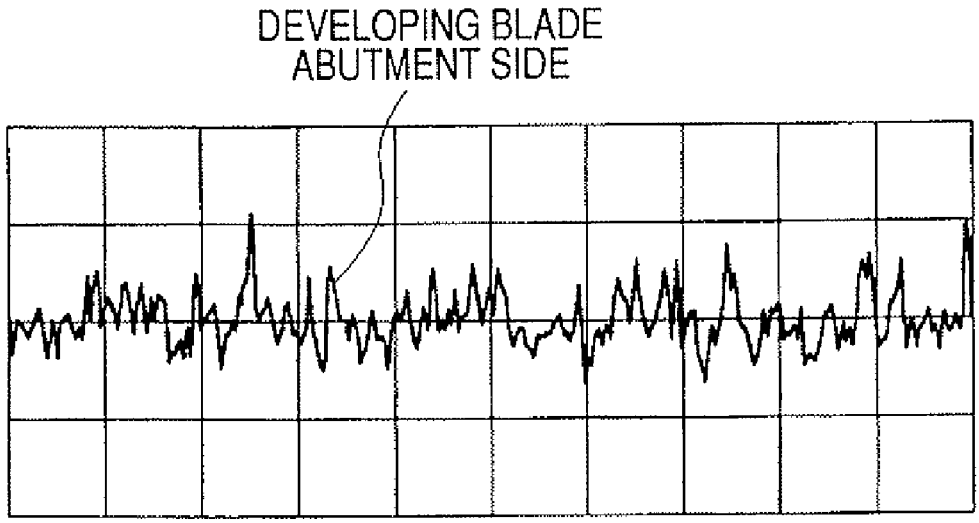
FIG. 13 is a diagrammatic sketch of a developing sleeve surface equivalent to Comparative Example 1-1-1.

FIG. 13 illustrates an example of a developing sleeve surface equivalent to Comparative Example 1-1-1 in which streak images are produced. Since there is no space on the developing sleeve into which toner can penetrate, and toner is strongly rubbed between the developing blade 2 and the developing sleeve 1, additive agent of the toner is clogged into concave portion of developing blade 2.

It should be noted that surfaces of the developing sleeve 1 illustrated in FIGS. 12 and 13 are represented by chart with a ratio of vertical to horizontal directions (vertical:horizontal) being approximately 1:40.

Next, a description of Pc2 will be given. A count level for specifying Pc2 in the present embodiment is set at 3 μm (half height of average particle diameter of toner=average particle diameter of toner/2). Pc2 in the present embodiment denotes the number of convex portions (per an evaluation length of 1 mm) having a height needed for toner to penetrate. From this fact, if Pc2 is too large, the number of convex portions increases, toner penetrating space becomes small, and thus streaks become worse. Conversely, if Pc2 is too small, that is, even if the number of convex portions is too few, streaks become worse. This is because, since the developing blade 2 is an elastic body, the developing blade 2 is flexed when a distance between convex portion and convex portion becomes wide; eventually, even with sufficient Rpk, toner is strongly rubbed between the developing blade 2 and the developing sleeve 1. Pc2 of Examples 1-1-1 to 1-1-5 in the present embodiment fall within the following range, thus no streak images were produced:

$2 \leqq Pc2 \leqq 10$

As discussed up to this point, according to the present embodiment, both of stability of toner layer thickness regulation and avoidance of occurrence of streak images can be established. That is, according to the present embodiment, stable toner layer thickness regulation can be performed, while suppressing streak image in an inexpensive method. In addition, according to the present embodiment, even in the case of using toner with a high circularity, occurrence of streak images can be avoided, and extended and stable toner layer thickness regulation can be implemented in an inexpensive method.

It should be noted that an elastic rubber member was used as the developing blade 2 in the above-mentioned present embodiment, but the present invention does not intend to limit to this. If a material has a moderate elasticity as the developing blade 2, the material is not particularly limited. Also, as an abutment method of the developing blade 2 to the developing sleeve 1, in the above-mentioned present embodiment, an example of abutting in counter direction to a rotation of the developing sleeve 1 was described. However, abutment is not limited to this, but abutment in a forward direction, for example, is effective in the present invention.

Also, the developing blade 2 that is pursuant to the present invention as described in conformity with the above-mentioned present embodiment exerts a particularly significant effect by a combination with toner with a high degree of circularity.

Also, a sleeve formed of a non-magnetic metal material was used as a developer carrying member in the above-mentioned present embodiment. However, the present invention does not intend to limit to this, but as a developer carrying member, for example, the present invention is applicable to the case of using a roller of which surface layer includes an elastic member. As a developer carrying member, whatever one having an adequate toner conveying force can be used.

Also, the above-mentioned present embodiment describes that the developing apparatus 5 is detachably mountable to the apparatus main body A as a process cartridge C. However, the present invention does not intend to limit to this, but the developing apparatus may be detachably mountable alone to the apparatus main body as a developing cartridge.

Further, the developing apparatus is not limited to a cartridge (process cartridge, developing cartridge) which is detachably mountable to the apparatus main body. As a matter of course, the present invention is equally applicable to an image forming apparatus in which the developing apparatus is substantially fixed to the apparatus main body.

This application claims the benefit of Japanese Patent Application No. 2006-049371, filed Feb. 24, 2006, which is hereby incorporated by reference herein in their entirety.

What is claimed is:

1. A developing apparatus comprising:

a developer carrying member that carries a mono-component developer; and a developer regulating member that abuts on the developer carrying member to regulate a thickness of a layer of the developer carried by the developer carrying member, wherein, surface roughness parameters of a surface of the developer carrying member satisfy the following equations (1) and (2), $$3.0 \leqq Rpk \leqq 9.0 \quad (1)$$

$$2 \leqq Pc2 \leqq 10 \text{ (where, count level=average particle diameter of developer (μm)/2, evaluation length=1 mm)} \quad (2),$$

and at least at an abutment portion between the developer carrying member and the developer regulating member, surface roughness parameters of a surface of the developer regulating member satisfy the following equations (3) and (4), $$0.030 \leqq Sm \leqq 0.170 \quad (3)$$

$$0.10 \leqq Rvk \times (100 - Mr2)/100 \leqq 1.30 \quad (4),$$

where,

Sm is a mean spacing of profile irregularities [mm] specified in JIS-B0601-1994;

Rpk is an initial wear height [μm] specified in DIN 4776;

Rvk is an oil retaining depth [μm] specified in DIN 4776;

Mr2 is a profile bearing length ratio 2 [%] specified in DIN 4776; and

Pc2 is a parameter measured by a Contact Surface Roughness Measuring Instrument SE3500 (manufactured by Kosaka Laboratory Ltd.), and denotes a number of profile peaks having a height larger than a count level (arbitrarily variable) from a center line per the evaluation length of 1 mm on a roughness curve.

2. A developing apparatus according to claim 1, wherein the surface of the developer regulating member is made of an elastic member at the abutment portion.

3. A developing apparatus according to claim 1, wherein an abutment width of the developer regulating member to the developer carrying member is 0.40 mm or more.

4. A developing apparatus according to claim 1, wherein a surface roughness parameter of the surface of the developer carrying member satisfies the following equation:

$$0.5 \leqq Ra \leqq 2.0$$

where,

Ra is an arithmetic mean roughness [μm] specified in JIS-B0601-1994.

5. A developing apparatus according to claim 1, wherein the mono-component developer has an average degree of circularity of 0.940 or more.

6. A developing apparatus according to claim 1, wherein the mono-component developer is a magnetic developer, and the developing apparatus further comprises a magnetic field generating member within the developer carrying member.

7. A developing apparatus according to claim 1, wherein the developing apparatus is provided in a cartridge that is detachably mountable to a main body of an image forming apparatus.

8. A developing apparatus according to claim 1, wherein the developing apparatus is provided in a cartridge that is detachably mountable to a main body of an image forming apparatus together with an image bearing member that bears an electrostatic image thereon.

* * * * *